US007554418B2

(12) United States Patent
Fujita

(10) Patent No.: US 7,554,418 B2
(45) Date of Patent: Jun. 30, 2009

(54) WAVEGUIDE/STRIP LINE CONVERTER HAVING A MULTILAYER SUBSTRATE WITH SHORT-CIRCUITING PATTERNS THEREIN DEFINING A WAVEGUIDE PASSAGE OF VARYING CROSS-SECTIONAL AREA

(75) Inventor: Akihisa Fujita, Anjo (JP)

(73) Assignee: Denso Corporation, Kariya (JP)

( * ) Notice: Subject to any disclaimer, the term of this patent is extended or adjusted under 35 U.S.C. 154(b) by 216 days.

(21) Appl. No.: 11/516,184

(22) Filed: Sep. 6, 2006

(65) Prior Publication Data

US 2007/0052504 A1 Mar. 8, 2007

(30) Foreign Application Priority Data

Sep. 7, 2005 (JP) ..... 2005-259692

(51) Int. Cl.
*H01P 5/107* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS 6,060,959 A * 5/2000 Yakuwa ..... 333/26
6,580,335 B1 6/2003 Iizuka et al.
6,816,028 B2 * 11/2004 Kato ..... 333/26
6,870,438 B1 * 3/2005 Shino et al. ..... 333/26
6,958,662 B1 10/2005 Salmela et al.

OTHER PUBLICATIONS

Office Action dated Mar. 13, 2008 in German Application No. 10 2006 041 994.4 with English translation thereof.

* cited by examiner

*Primary Examiner*—Benny Lee
(74) *Attorney, Agent, or Firm*—Harness, Dickey & Pierce, PLC

(57) ABSTRACT

A waveguide/strip line converter includes a waveguide and a multilayer substrate. A second end of the multilayer substrate is fixed to an opening of the waveguide. The multilayer substrate includes a plurality of dielectric layers to form a plurality of substrate faces. A top substrate face includes a strip line and a first short-circuiting metal pattern. First and second intermediate substrate faces include second and third short-circuiting metal patterns with openings, respectively. A matching element forming substrate face includes a matching element, which is electromagnetically coupled with the strip line. A waveguide passage extends through the openings between the strip line and the matching element. A cross sectional area of the opening is larger than that of the opening.

9 Claims, 5 Drawing Sheets

WAVEGUIDE/STRIP LINE CONVERTER HAVING A MULTILAYER SUBSTRATE WITH SHORT-CIRCUITING PATTERNS THEREIN DEFINING A WAVEGUIDE PASSAGE OF VARYING CROSS-SECTIONAL AREA

CROSS REFERENCE TO RELATED APPLICATION

This application is based on and incorporates herein by reference Japanese Patent Application No. 2005-259692 filed on Sep. 7, 2005.

BACKGROUND OF THE INVENTION

1. Field of the Invention

The present invention relates to a waveguide/strip line converter, which converts electric power in a microwave or millimeter wave band.

2. Description of Related Art

A waveguide/strip line converter conventionally includes a short-circuiting layer (a metal layer), a matching element, and a dielectric substrate (e.g., JP-2000-244212-A (corresponding to U.S. Pat. No. 6,580,335)). The short-circuiting layer has a slit, which is disposed at an opening of a waveguide. The matching element is disposed on an inner side of the waveguide, and the short-circuiting layer and the matching element are disposed generally parallel to each other with a predetermined gap formed therebetween. The dielectric substrate is provided in this predetermined gap. The matching element and a strip line, which is formed in the slit of the short-circuiting layer, are electromagnetically connected as a result of disposing them close to each other. A conversion of electric power by means of this electromagnetic connection of the matching element and the strip line eliminates the use of a short-circuiting waveguide block.

According to the above conventional art, a high frequency circuit is arranged on the substrate on which the strip line is formed. When a power supply line to drive the high frequency circuit is formed on the same substrate on which the strip line is formed, an electric current circulating through the power supply line sometimes has an influence on the strip line. The influence on the strip line can be reduced, for example, by including a multilayer substrate in the converter, and by forming the power supply line on a different substrate from the substrate on which the strip line is formed.

When the converter includes the multilayer substrate, a waveguide passage, through which a radio wave propagates, is formed between the strip line and the matching element. For instance, due to a positional shift, which is generated between adjacent substrates while the multilayer substrate is being produced, the waveguide passage on a lower layer side of a grounding metal pattern of the strip line protrudes into an inner side of the waveguide passage that is formed on the grounding metal pattern. As a result, a resonance characteristic of the matching element, that is, a characteristic of the converter deteriorates.

SUMMARY OF THE INVENTION

The present invention addresses the above disadvantages. Thus, it is an objective to provide a waveguide/strip line converter that can reduce deterioration in the characteristic of the converter, which includes a multilayer substrate.

To achieve the objective of the present invention, there is provided a waveguide/strip line converter, which includes a waveguide and a multilayer substrate. The multilayer substrate has a first end and a second end, which are opposed to each other. The second end of the multilayer substrate is fixed to an opening of the waveguide. The multilayer substrate includes a plurality of dielectric layers, which are stacked one after another between the first end and the second end of the multilayer substrate in a stacking direction to form a plurality of substrate faces. The plurality of substrate faces includes a top substrate face, a first intermediate substrate face, a second intermediate substrate face, and a matching element substrate face. The top substrate face is placed in the first end of the multilayer substrate and includes a strip line and a first short-circuiting metal pattern, which are spaced from each other. The first intermediate substrate face is positioned on a waveguide side of the top substrate face in the stacking direction and includes a second short-circuiting metal pattern, which has an opening. The second intermediate substrate face is positioned on a waveguide side of the first intermediate substrate face in the stacking direction and includes a third short-circuiting metal pattern, which has an opening. The matching element substrate face is positioned on a waveguide side of the second intermediate substrate face and includes a matching element, which is electromagnetically coupled with the strip line. A waveguide passage is formed to extend through the opening of the second short-circuiting metal pattern and the opening of the third short-circuiting metal pattern in the stacking direction between the strip line and the matching element in the multilayer substrate. The first short-circuiting metal pattern, the second short-circuiting metal pattern, the third short-circuiting metal pattern and the waveguide are grounded together. A cross sectional area of the opening of the third short-circuiting metal pattern is larger than a cross sectional area of the opening of the second short-circuiting metal pattern.

To achieve the objective of the present invention, there is also provided a waveguide/strip line converter, which includes a waveguide and a multilayer substrate. The multilayer substrate has a first end and a second end, which are opposed to each other. The second end of the multilayer substrate is fixed to an opening of the waveguide. The multilayer substrate includes a plurality of dielectric layers that are stacked one after another between the first end and the second end of the multilayer substrate in a stacking direction to form a plurality of substrate faces. The plurality of substrate faces includes a top substrate face, a first intermediate substrate face, a second intermediate substrate face, and a matching element substrate face. The top substrate face is placed in the first end of the multilayer substrate and includes a strip line and a first short-circuiting metal pattern, which are spaced from each other. The first intermediate substrate face is positioned on a waveguide side of the top substrate face in the stacking direction and includes a second short-circuiting metal pattern, which has an opening. The second intermediate substrate face is positioned on a waveguide side of the first intermediate substrate face in the stacking direction and includes a third short-circuiting metal pattern, which has an opening. The matching element substrate face is positioned on a waveguide side of the second intermediate substrate face and includes a matching element, which is electromagnetically coupled with the strip line. A waveguide passage is formed to extend through the opening of the second short-circuiting metal pattern and the opening of the third short-circuiting metal pattern in the stacking direction between the strip line and the matching element in the multilayer substrate. The first short-circuiting metal pattern, the second short-circuiting metal pattern, the third short-circuiting metal pattern and the waveguide are grounded together. A portion of an inner edge of the opening of the third short-circuiting metal pattern, which is overlapped with the strip line in the stacking direction, is further recessed away from a center axis of the wave guide in comparison to a portion of an inner edge of the opening of the second short-circuiting metal pattern, which is overlapped with the strip line in the stacking direction.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
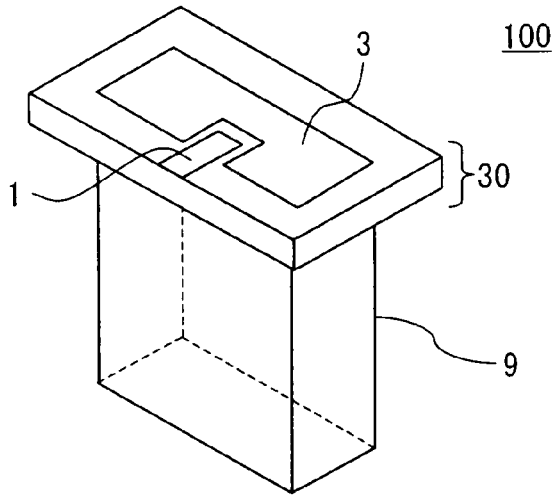
FIG. 1 is a perspective view of a waveguide/strip line converter according to an embodiment of the present invention.

Embodiments will be described below with reference to drawings. Like reference labels appearing in different drawing figures refer to the same feature or element and may not be described in detail for all drawing figures in which they appear. FIG. 1 is a perspective view of a waveguide/strip line converter 100. As shown in FIG. 1, the waveguide/strip line converter 100 of the present embodiment is a converter having a multilayer substrate structure. A radio wave with a microwave or millimeter wave band enters through or/and is emitted from one end (i.e., a lower end in FIG. 1) of a waveguide 9 of the waveguide/strip line converter 100. A multilayer substrate 30 is disposed at an opening 9*a* (FIG. 2A) at the other end (i.e., an upper end in FIG. 1) of the waveguide 9.

Figure 2A:
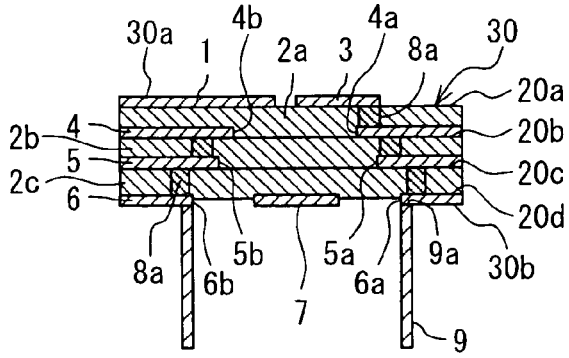
FIG. 2A is a cross-sectional view of the waveguide/strip line converter taken along a line IIA-IIA in FIG. 2B according to the embodiment.

FIGS. 2A to 2E show the multilayer substrate structure. The multilayer substrate 30 includes a plurality of dielectric layers 2*a*, 2*b*, and 2*c*, which are stacked one after another. FIG. 2A is a cross-sectional view of the waveguide/strip line converter 100 of FIG. 1. FIGS. 2B, 2C, 2D, 2E are plan views of a top substrate face 20*a*, a first intermediate substrate face 20*b*, a second intermediate substrate face 20*c*, and a matching element substrate face 20*d* of the multilayer substrate 30, respectively. The top substrate face 20*a* is placed in a first end 30*a* of the multiplayer substrate 30 of FIG. 2A. Furthermore, the matching element substrate face 20*d* is placed in a second end 30*b* of the multilayer substrate 30, which is opposed to the first end 30*a* of the multilayer substrate 30 as shown in FIG. 2A.

Figure 2B:
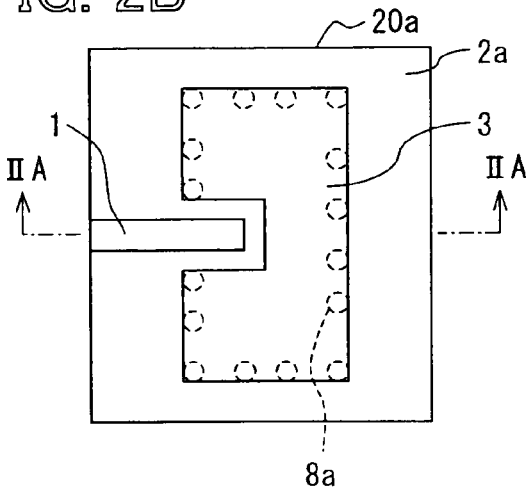
FIG. 2B is a plan view of a top substrate face of a multilayer substrate according to the embodiment.

As shown in FIG. 2B, a microstrip line (MSL) 1 is disposed on the top substrate face 20*a* of the dielectric layer 2*a* of the multilayer substrate 30. A first short-circuiting metal pattern 3 is placed in the top substrate face 20*a* in such a manner that the first short-circuiting metal pattern 3 is spaced from the MSL 1 by a predetermined distance.

Figure 2C:
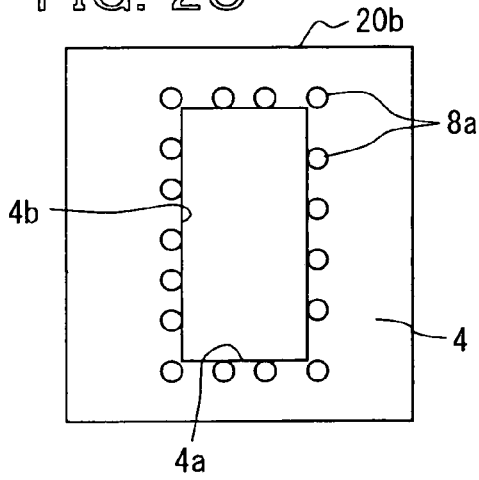
FIG. 2C is a plan view of a first intermediate substrate face of the multilayer substrate according to the embodiment.
Figure 2D:
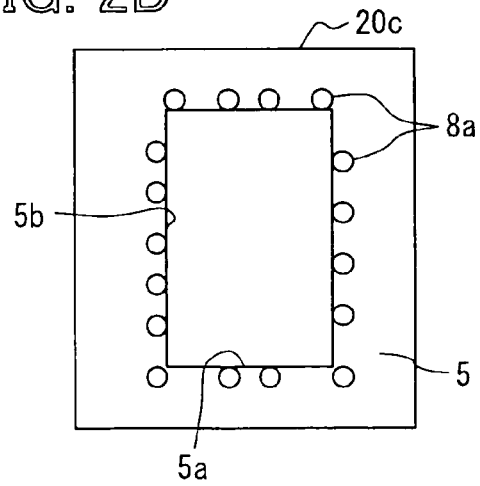
FIG. 2D is a plan view of a second intermediate substrate face of the multilayer substrate according to the embodiment.

As shown in FIG. 2C, a second short-circuiting metal pattern 4 is disposed in the first intermediate substrate face 20*b* formed between the dielectric layer 2*a* and the dielectric layer 2*b* of the multilayer substrate 30 as shown in FIG. 2A. An opening 4*a* (FIGS. 2A and 2C) is formed as a waveguide passage in a central region of the second short-circuiting metal pattern 4. Likewise, a third short-circuiting metal pattern 5 is placed in the second intermediate substrate face 20*c* formed between the dielectric layer 2*b* and the dielectric layer 2*c* of the multilayer substrate 30, as shown in FIG. 2D. An opening 5*a* (FIGS. 2A, 2D) is formed as the waveguide passage in a central region of the third short-circuiting metal pattern 5.

Figure 3A:
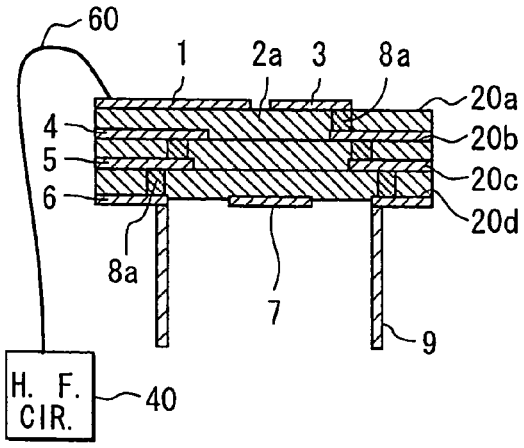
FIG. 3A is a cross-sectional view of the waveguide/strip line converter taken along a line IIIA-IIIA in FIG. 3B, which illustrates an application of a high frequency circuit and a power supply line to the multilayer substrate according to the embodiment.
Figure 3B:
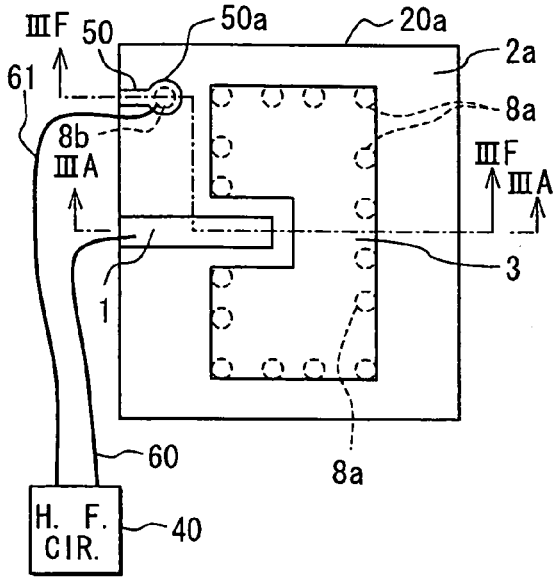
FIG. 3B is a plan view of the top substrate face of the multilayer substrate, to which the high frequency circuit and the power supply line are applied, according to the embodiment.
Figure 3C:
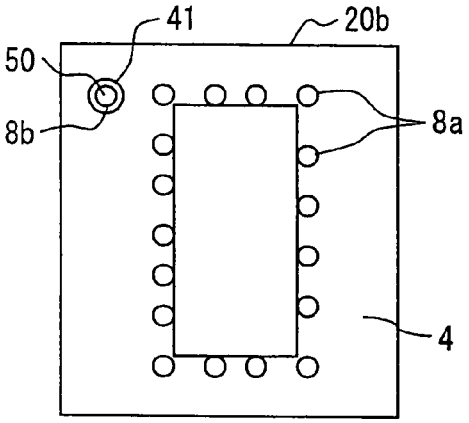
FIG. 3C is a plan view of the first intermediate substrate face of the multilayer substrate, to which the power supply line is applied, according to the embodiment.
Figure 3D:
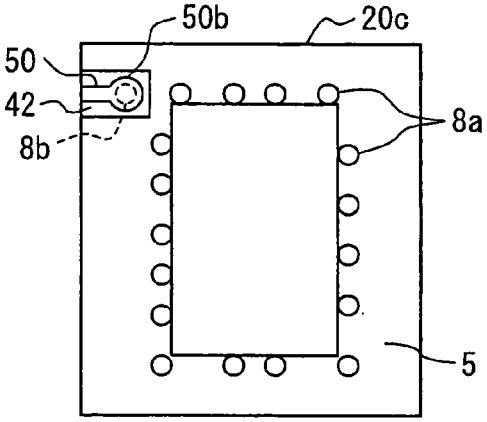
FIG. 3D is a plan view of the second intermediate substrate face of the multilayer substrate, to which the power supply line is applied, according to the embodiment.
Figure 3E:
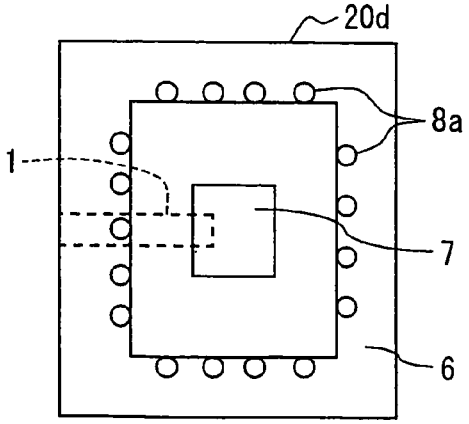
FIG. 3E is a plan view of the matching element forming substrate face of the multilayer substrate according to the embodiment.
Figure 3F:
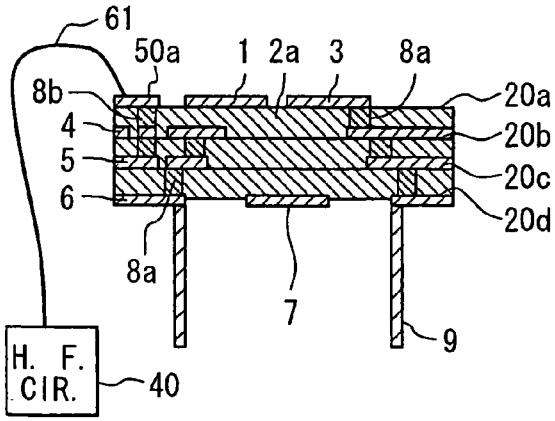
FIG. 3F is a cross-sectional view of the waveguide/strip line converter taken along a line IIIF-IIIF in FIG. 3B, which illustrates an application of a high frequency circuit and a power supply line to the multilayer substrate according to the embodiment.

In addition, as shown in FIGS. 3A, 3B, 3C, 3D, 3F, a power supply line50 (FIGS. 3B, 3C, 3D and 3F to drive the MSL 1 (FIGS. 3A, 3C, 3E and 3F) or a high frequency (H.F.) circuit 40, for example, may be placed in the second intermediate substrate face 20*c*. The power supply line 50 includes a conductive line 50*a*, a via 8*b*, and a conductive line 50*b*. Insulating regions 41, 42 are parts of the dielectric layer 2*b* and the dielectric layer 2*c*, respectively. In the insulating regions 41 (FIG. 3C), 42 (FIG. 3D), the corresponding second and the third short-circuiting metal patterns 4, 5 are not formed. The high frequency circuit 40 is fed with electric power by the power supply line 50, which is electrically connected to the high frequency circuit 40, through the via 8*b* that penetrates through the multilayer substrate 30 up to the top substrate face 20*a*. Then, the via 8*b* is connected to the high frequency circuit 40 through, for example, a wire 61 (FIGS. 3B, 3F). The high frequency circuit 40 may be connected to the MSL 1 by, for example, a wire 60 (FIGS. 3A, 3B). Accordingly, a resulting high-frequency connection between the power supply line 50 and the MSL 1 can reduce deterioration in a signal of the MSL 1.

Figure 2E:
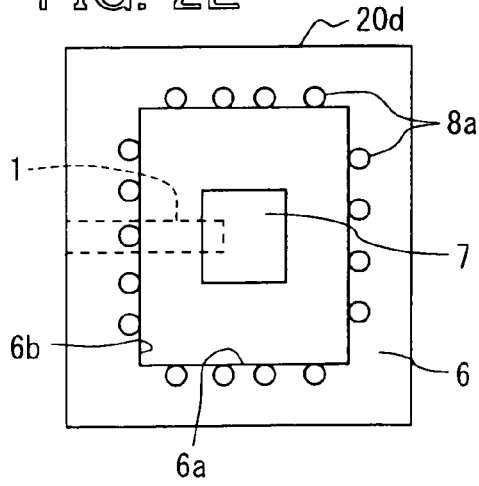
FIG. 2E is a plan view of a matching element forming substrate face of the multilayer substrate according to the embodiment.

As shown in FIG. 2E, a fourth short-circuiting metal pattern 6 and a matching element 7 are placed on the matching element substrate face 20*d* of the multilayer substrate 30. An opening 6*a* is formed as the waveguide passage in a central region of the fourth short-circuiting metal pattern 6. The fourth short-circuiting metal pattern 6 is electrically connected and secured to the upper opening 9*a* of the waveguide 9 by a welding or a soldering as shown in FIG. 2A. Consequently, the multilayer substrate 30 is secured to the opening 9*a* at the other end of the waveguide 9.

Besides, as shown in FIG. 2A, the first short-circuiting metal pattern 3 on the top substrate face 20*a*, the second short-circuiting metal pattern 4 in the first intermediate substrate face 20*b*, the third short-circuiting metal pattern 5 in the second intermediate substrate face 20*c*, and the fourth short-circuiting metal pattern 6 on the matching element substrate face 20*d* are electrically connected to one another through vias 8*a*, thereby being maintained at the same potential (including the waveguide 9). Additionally, these conductors (i.e., the MSL 1, the first short-circuiting metal pattern 3 on the top substrate face 20*a*, the second short-circuiting metal pattern 4 in the first intermediate substrate face 20*b*, the third short-circuiting metal pattern 5 in the second intermediate substrate face 20*c*, the power supply line 50 (e.g. FIGS. 3B to 3D), and the fourth short-circuiting metal pattern 6 on the matching element substrate face 20*d*) are formed by a process such as a photoetching.

As shown in FIG. 2A, since the second short-circuiting metal pattern 4 is placed in the first intermediate substrate face 20*b*, which is different from the substrate face (i.e., 20*d*) where the matching element 7 is disposed, the MSL 1 can be formed with a minimum substrate thickness as well as in a relatively narrow width, thereby reducing a size of the MSL 1.

Next, a characteristic part of the waveguide/strip line converter 100 will be described below. As in the case of the present embodiment, when the waveguide/strip line converter 100 includes the multilayer substrate 30, the waveguide passage (i.e., the above openings 4*a*, 5*a*), through which a radio wave propagates, is formed between the MSL 1 and the matching element 7. For instance, it can be assumed that the openings (i.e., the openings 5*a*, 6*a*), which are formed on a waveguide 9 side of the first intermediate substrate face 20*b* in a stacking direction, have approximately the same cross sectional areas as the opening 4*a*. In such a case, if a positional shift is generated between adjacent layers (the dielectric layers 2*a* to 2*c*) while the multilayer substrate 30 is being produced, inner edges of the above openings (i.e., inner edges 5*b*, 6*b*, respectively) may further protrude towards a center axis of the waveguide 9, as compared to a portion of an inner edge 4*b* of the opening 4*a*, which is overlapped with these inner edges in the stacking direction. As a result, a resonance characteristic of the matching element 7 (i.e., a characteristic of the converter) deteriorates.

That is to say, because of a strong electromagnetic coupling between the MSL 1 and the matching element 7, arrangement of the third short-circuiting metal pattern 5 and the fourth short-circuiting metal pattern 6 considerably influences the resonance characteristic of the matching element 7. An electromagnetic loss increases particularly when the inner edges 5*b*, 6*b* of the respective openings 5*a*, 6*a* further protrude towards the center axis of the waveguide 9, as compared to the portion of the inner edge 4*b* of the opening 4*a* of the second short-circuiting metal pattern 4, which is overlapped with these inner edges 5*b*, 6*b* in the stacking direction. Therefore, although it would be ideal if the multilayer substrate 30 were produced such that there were no positional shifts between adjacent layers, yet practically, the positional shift necessarily exists.

Further protrusions of the inner edges (i.e., the inner edges 5*b*, 6*b*) of the openings (i.e., the respective openings 5*a*, 6*a*), which are formed on the waveguide 9 side of the first intermediate substrate face 20*b* in the stacking direction, towards the center axis of the waveguide 9 as compared to the portion of the inner edge 4*b* of the opening 4*a* of the second short-circuiting metal pattern 4, which is overlapped with these inner edges in the stacking direction, cause serious deterioration in the converter characteristic. Nevertheless, substantially no deterioration occurs if the inner edges of the openings that are formed on the waveguide 9 side of the first intermediate substrate face 20*b* in the stacking direction are further recessed away from the center axis of the waveguide 9 as compared to the portion of the inner edge 4*b*, which is overlapped with these inner edges in the stacking direction. Given the above fact, the present embodiment employs the multilayer substrate structure, which can permit the positional shift between adjacent layers, in producing the multilayer substrate 30.

That is, when a tolerance of ±S, for example, is allowed for the positional shift between adjacent layers in producing the multilayer substrate 30, most of the influence of the positional shift, and accordingly the electromagnetic loss can be decreased by recessing each inner edge 5*b* of the opening 5*a* and each inner edge 6*b* of the opening 6*a* by an amount s from the portion of the inner edge 4*b* of the opening 4*a*, which is overlapped with the each inner edge 5*b* and the each inner edge 6*b*, respectively in the stacking direction (so that widths of cross sectional areas of the openings 5*a*, 6*a* are made larger by 2S (=2×s) than a width of a cross sectional area of the opening 4*a*).

Thus, as shown in FIGS. 2A to 2E, the widths of the cross sectional areas of the openings 5*a*, 6*a* formed in the respective substrate faces 20*c*, 20*d*, which are located on the waveguide 9 side of the first intermediate substrate face 20*b* in the stacking direction, are made larger than the width of the cross sectional area of the opening 4*a* in the first intermediate substrate face 20*b* (so that the each inner edge 5*b* and the each inner edge 6*b* are overlapped with the inner edge 4*b* of the opening 4*a* in the stacking direction ).

As a consequence, despite the positional shift between adjacent layers, the multilayer substrate 30 can be produced, such that the inner edges 5*b*, 6*b* of the respective openings 5*a*, 6*a* on the waveguide 9 side of the first intermediate substrate face 20*b* in the stacking direction do not protrude towards the center axis of the waveguide 9, further than the inner edge 4*b* of the opening 4*a* of the second short-circuiting metal pattern 4. For this reason, the deterioration in the resonance characteristic of the matching element 7 (i.e., in the converter characteristic) can be reduced.

More specifically, as shown in FIG. 2A, the each inner edge 5*b* of the opening 5*a* is further recessed from the center axis of the waveguide 9 as compared to the inner edge 4*b* of the opening 4*a*, so that the width of the cross sectional area of the opening 5*a* is larger than that of the opening 4*a*. By the same token, the each inner edge 6*b* of the opening 6*a* is further recessed from the center axis of the waveguide 9 than the inner edge 5*b* of the opening 5*a*, so that the width of the cross sectional area of the opening 6*a* is larger than that of the opening 5*a*. Consequently, if more dielectric layers are included in the multilayer substrate 30, as the openings are located further on the waveguide 9 side of the first intermediate substrate face 20*b* in the stacking direction, the widths of the cross sectional areas of these openings are made larger accordingly.

Thus far, the embodiment of the present invention has been described. However, the present invention is not by any means limited to the above embodiment, and it can be embodied in various ways without departing from the scope of the invention.

(First Modification)

Figure 4A:
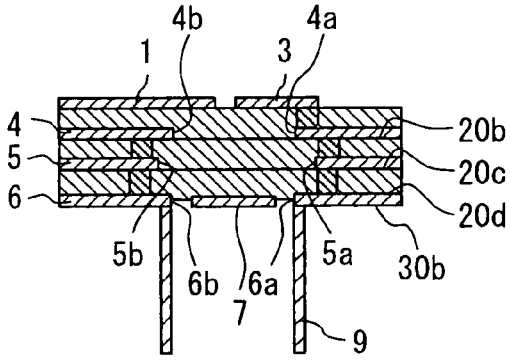
FIG. 4A is a cross-sectional view of the waveguide/strip line converter taken along a line IVA-IVA in FIG. 4B according to a first modification of the embodiment.
Figure 4B:
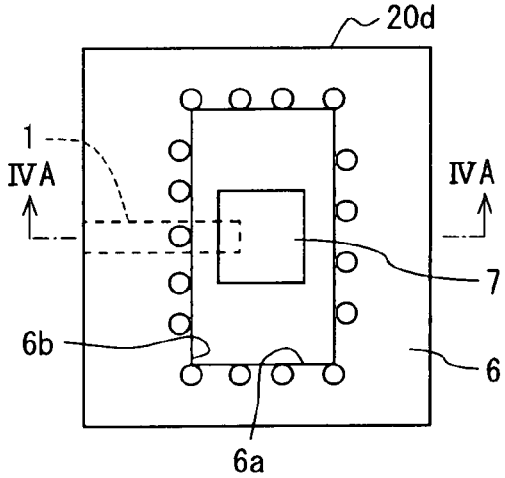
FIG. 4B is a plan view of the matching element forming substrate face of the multilayer substrate according to the first modification of the embodiment.

As has been mentioned in the above embodiment, the arrangement of the third short-circuiting metal pattern 5 and the fourth short-circuiting metal pattern 6 considerably influences the resonance characteristic of the matching element 7 due to the strong electromagnetic coupling between the MSL 1 and the matching element 7. In particular, the arrangement of the third short-circuiting metal pattern 5, which is located closer to the MSL 1 in relation to the other metal pattern (i.e., the fourth short-circuiting metal pattern 6) located on the waveguide 9 side of the first intermediate substrate face 20*b* in the stacking direction, has more significant influence upon the resonance characteristic of the matching element 7 than that of the fourth short-circuiting metal pattern 6. Because of this, as far as the fourth short-circuiting metal pattern 6 is concerned, its opening may take a size, for which the tolerance of±S is not allowed as shown in FIGS. 4A, 4B (i.e., the fourth short-circuiting metal pattern 6 may have the opening 6*a* of the same size as the opening 4*a* of the second short-circuiting metal pattern 4).

Figure 4C:
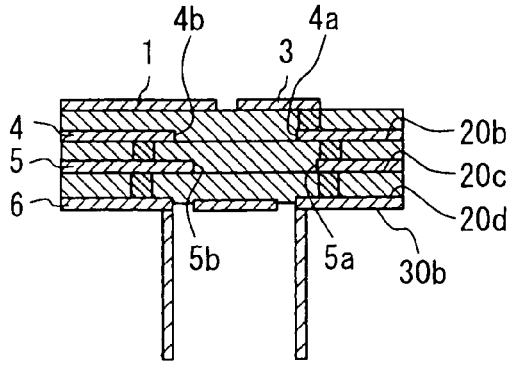
FIG. 4C RELATED ART
FIG. 4C is a cross-sectional view of the waveguide/strip line converter similar to FIG. 4A, illustrating a problematic greater protrusion of a portion of an inner edge of an opening of a third short-circuiting metal pattern, which is overlapped with a strip line in a stacking direction, towards a center axis of a waveguide, as compared to a portion of an inner edge of an opening of a second short-circuiting metal pattern, which is overlapped with the strip line in the stacking direction.
Figure 4D:
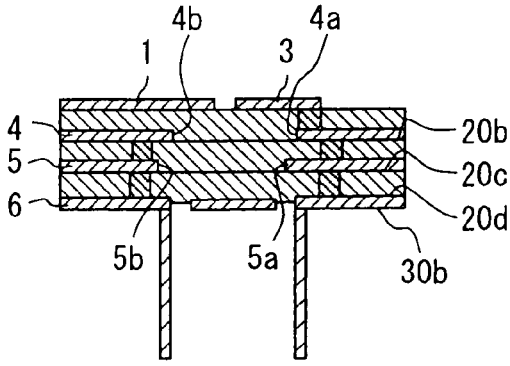
FIG. 4D is a cross-sectional view of the waveguide/strip line converter according to the first modification of the embodiment.

In addition to the more significant influence of the arrangement of the third short-circuiting metal pattern 5 upon the resonance characteristic of the matching element 7 than that of the fourth short-circuiting metal pattern 6, a comparative example FIG. 4C illustrates the most problematic arrangement of the third short-circuiting metal pattern 5. A further protrusion of a portion of the inner edge 5*b* of the opening 5*a* (from which a millimeter wave is transmitted), which is overlapped with the MSL 1 in the stacking direction, towards the center axis of the waveguide 9, in comparison to the inner edge 4*b* of the opening 4*a*, which is overlapped with the MSL 1 in the stacking direction, causes the most serious deterioration in the signal of the MSL 1. Consequently, the signal loss can be best reduced if a width of a cross sectional area of an opening of a short-circuiting metal pattern (i.e., the opening 5*a* of the third short-circuiting metal pattern 5), which is located closest to the MSL 1 among the metal pattern(s) placed on the waveguide 9 side of the first intermediate substrate face 20*b* in the stacking direction, is larger than the width of the cross sectional area of the opening 4*a* by more than the positional shift tolerance, provided that the portion of the inner edge 5*b* of the opening 5*a*, which is overlapped with the MSL 1 in the stacking direction, is further recessed away from the center axis of the waveguide 9 in comparison to the portion of the inner edge 4*b* of the opening 4*a*, which is overlapped with the MSL 1 in the stacking direction (see FIG. 4D).

(Second Modification)

Figure 5A:
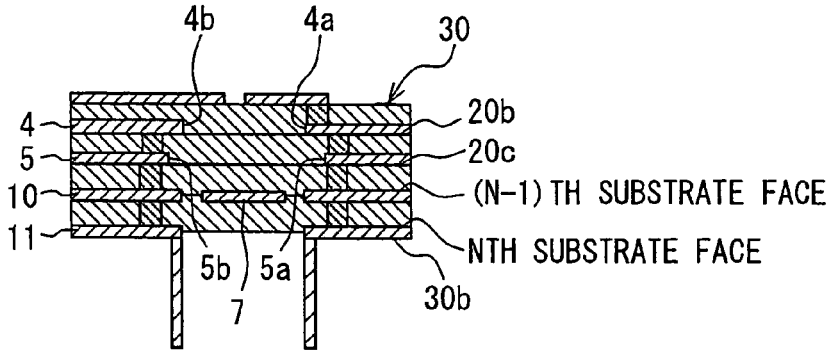
FIG. 5A is a cross-sectional view of the waveguide/strip line converter taken along a line VA-VA in FIG. 5B according to a second modification of the embodiment.
Figure 5B:
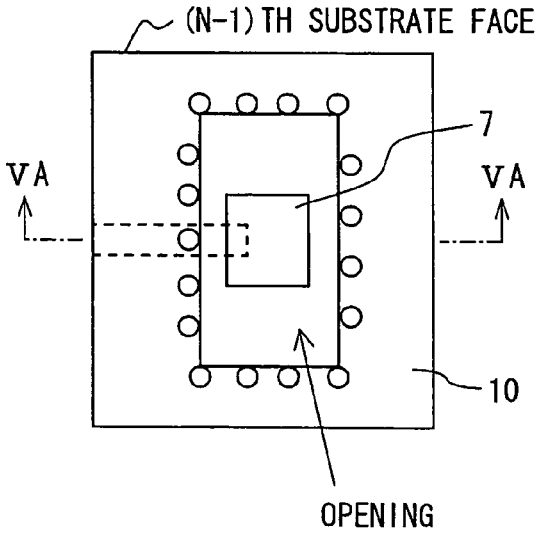
FIG. 5B is a plan view of a (n-1)th substrate face of the multilayer substrate according to the second modification of the embodiment.
Figure 5C:
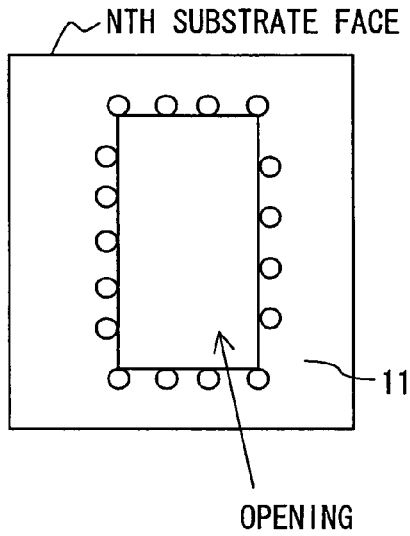
FIG. 5C is a plan view of an nth substrate face of the multilayer substrate according to the second modification of the embodiment.

FIGS. 5A to 5C show the multilayer substrate structure of the present modification. FIG. 5A is a cross-sectional view of the waveguide/strip line converter 100. FIGS. 5B, 5C are plan views of (n-1)th and nth substrate faces of the multilayer substrate, respectively.

As shown in FIGS. 5A and 5B, the matching element 7 and a short-circuiting metal pattern 10 are disposed in the (n-1)th substrate face. An opening is formed as the waveguide passage in a central region of the short-circuiting metal pattern 10. Also, a short-circuiting metal pattern 11 (FIGS. 5A and 5C) included in the second end 30*b* of the multilayer substrate 30 (FIG. 5A) is disposed on the nth substrate face. By the same token, an opening is formed as the waveguide passage in a central region of the short-circuiting metal pattern 11.

Figure 6A:
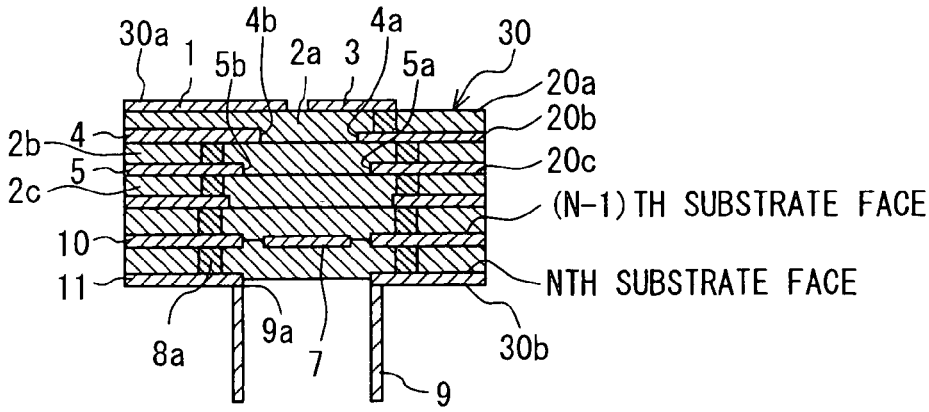
FIG. 6A is a cross-sectional view of the waveguide/strip line converter taken along a line VIA-VIA in FIG. 6B according to the second modification of the embodiment.
Figure 6B:
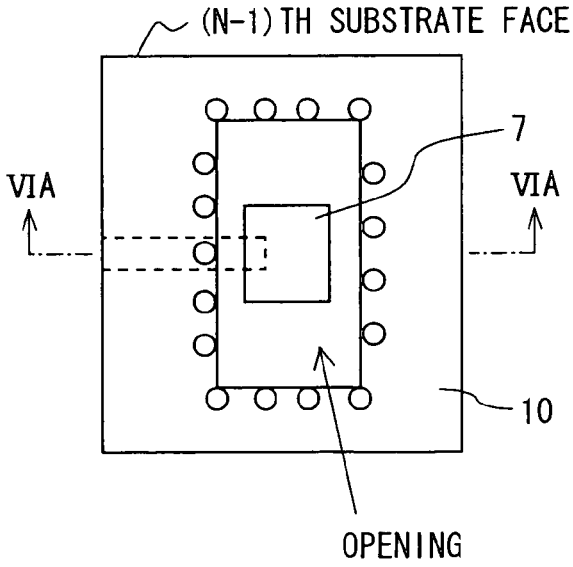
FIG. 6B is a plan view of the (n-1)th substrate face of the multilayer substrate according to the second modification of the embodiment.
Figure 6C:
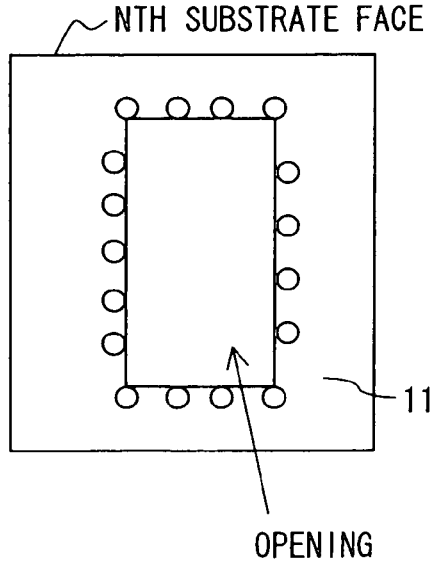
FIG. 6C is a plan view of the nth substrate face of the multilayer substrate according to the second modification of the embodiment.

Referring to FIG. 5A, even though the matching element 7 is disposed in the substrate face, which is located between the first intermediate substrate face 20*b* and the nth substrate face (on which the short-circuiting metal pattern 11 is placed), the deterioration in the resonance characteristic of the matching element 7 can be reduced if each inner edge of an opening formed between the second intermediate substrate face 20*c* and the nth substrate face is further recessed from the center axis of the waveguide 9 as compared to the inner edge 4*b* of the opening 4*a*, so that widths of cross sectional areas of the openings between the second intermediate substrate face 20*c* and the nth substrate face are larger than the width of the cross sectional area of the opening 4*a*. That is, making larger the widths of the cross sectional areas of the openings that are located on the waveguide 9 side of the first intermediate substrate face 20*b* in the stacking direction than the width of the cross sectional area of the opening 4*a* in the first intermediate substrate face 20*b* can reduce the deterioration in the resonance characteristic of the matching element 7 (i.e., in the converter characteristic). FIGS. 6A to 6C show the multilayer substrate 30, in which two substrate faces are formed between the second intermediate substrate face 20*c* and the nth substrate face.

(Third Modification)

In the above embodiment and the modifications, the matching element7 has had a quadrangular shape when shown in plan view. However, the matching element 7 is not restricted to any particular shape. In fact, a round shape, a ring shape or the like may be employed for the matching element 7. In addition, the waveguide 9 (FIGS. 1, 2A, 3A, 3F, 4A,and 6A) may be filled with dielectric materials or the like, which has not been mentioned in the above embodiments.

Additional advantages and modifications will readily occur to those skilled in the art. The invention in its broader terms is therefore not limited to the specific details, representative apparatus, and illustrative examples shown and described.

What is claimed is:

1. A waveguide/strip line converter comprising:

a waveguide; and a multilayer substrate that has a first end and a second end, which are opposed to each other, wherein the second end of the multilayer substrate is fixed to an opening of the waveguide, and the multilayer substrate includes a plurality of dielectric layers that are stacked one after another between the first end and the second end of the multilayer substrate in a stacking direction to provide a plurality of substrate faces, which include:

a top substrate face that is placed in the first end of the multilayer substrate and includes a strip line and a first short-circuiting metal pattern, which are spaced from each other;

a first intermediate substrate face that is positioned on a waveguide side of the top substrate face in the stacking direction and includes a second short-circuiting metal pattern, which has an opening;

a second intermediate substrate face that is positioned on a waveguide side of the first intermediate substrate face in the stacking direction and includes a third short-circuiting metal pattern, which has an opening; and a matching element substrate face that is positioned on a waveguide side of the second intermediate substrate face and includes a matching element, which is electromagnetically coupled with the strip line, and a fourth short-circuiting metal pattern, which has an opening, wherein:

a waveguide passage extends through the opening of the second short-circuiting metal pattern and the opening of the third short-circuiting metal pattern in the stacking direction between the strip line and the matching element in the multilayer substrate;

the first short-circuiting metal pattern, the second short-circuiting metal pattern, the third short-circuiting metal pattern, the fourth short-circuiting metal pattern and the waveguide are grounded together;

a cross sectional area of the opening of the third short-circuiting metal pattern is larger than a cross sectional area of the opening of the second short-circuiting metal pattern; and the cross sectional area of the opening of the third short-circuiting metal pattern is larger than a cross sectional area of the opening of the fourth short-circuiting metal pattern.

2. The waveguide/strip line converter according to claim 1, wherein the matching element substrate face is spaced from the second end of the multilayer substrate on a top substrate face side of the second end of the multilayer substrate in the stacking direction.

3. The waveguide/strip line converter according to claim 1, wherein the matching element substrate face is positioned in the second end of the multilayer substrate.

4. A waveguide/strip line converter comprising:

a waveguide;

a multilayer substrate that has a first end and a second end, which are opposed to each other, wherein the second end of the multilayer substrate is fixed to an opening of the waveguide, and the multilayer substrate includes a plurality of dielectric layers that are stacked one after another between the first end and the second end of the multilayer substrate in a stacking direction to provide a plurality of substrate faces, which include:

a top substrate face that is placed in the first end of the multilayer substrate and includes a strip line and a first short-circuiting metal pattern, which are spaced from each other;

a first intermediate substrate face that is positioned on a waveguide side of the top substrate face in the stacking direction and includes a second short-circuiting metal pattern, which has an opening;

a second intermediate substrate face that is positioned on a waveguide side of the first intermediate substrate face in the stacking direction and includes a third short-circuiting metal pattern, which has an opening; and a matching element substrate face that is positioned on a waveguide side of the second intermediate substrate face and includes a matching element, which is electromagnetically coupled with the strip line, and:

a high frequency circuit that is connected to the strip line, wherein;

a waveguide passage extends through the opening of the second short-circuiting metal pattern and the opening of the third short-circuiting metal pattern in the stacking direction between the strip line and the matching element in the multilayer substrate;

the first short-circuiting metal pattern, the second short-circuiting metal pattern, the third short-circuiting metal pattern and the waveguide are grounded together;

a portion of an inner edge of the opening of the third short-circuiting metal pattern, which is overlapped with the strip line in the stacking direction, is further recessed away from a center axis of the wave guide in comparison to a portion of an inner edge of the opening of the second short-circuiting metal pattern, which is overlapped with the strip line in the stacking direction; and one of the plurality of substrate faces other than the top substrate face includes a power supply line, which is connected to the high frequency circuit to drive the high frequency circuit.

5. A waveguide/strip line converter comprising:

a waveguide;

a multilayer substrate that has a first end and a second end, which are opposed to each other, wherein the second end of the multilayer substrate is fixed to an opening of the waveguide, and the multilayer substrate includes a plurality of dielectric layers that are stacked one after another between the first end and the second end of the multilayer substrate in a stacking direction to provide a plurality of substrate faces, which include:

a top substrate face that is placed in the first end of the multilayer substrate and includes a strip line and a first short-circuiting metal pattern, which are spaced from each other;

a first intermediate substrate face that is positioned on a waveguide side of the top substrate face in the stacking direction and includes a second short-circuiting metal pattern, which has an opening;

a second intermediate substrate face that is positioned on a waveguide side of the first intermediate substrate face in the stacking direction and includes a third short-circuiting metal pattern, which has an opening; and a matching element substrate face that is positioned on a waveguide side of the second intermediate substrate face and includes a matching element, which is electromagnetically coupled with the strip line, and:

a high frequency circuit that is connected to the strip line, wherein;

a waveguide passage extends through the opening of the second short-circuiting metal pattern and the opening of the third short-circuiting metal pattern in the stacking direction between the strip line and the matching element in the multilayer substrate;

the first short-circuiting metal pattern, the second short-circuiting metal pattern, the third short-circuiting metal pattern and the waveguide are grounded together;

a cross sectional area of the opening of the third short-circuiting metal pattern is larger than a cross sectional area of the opening of the second short-circuiting metal pattern; and one of the plurality of substrate faces other than the top substrate face includes a power supply line, which is connected to the high frequency circuit to drive the high frequency circuit.

6. A waveguide/strip line converter comprising:

a waveguide; and a multilayer substrate that has a first end and a second end, which are opposed to each other, wherein the second end of the multilayer substrate is fixed to an opening of the waveguide, and the multilayer substrate includes a plurality of dielectric layers that are stacked one after another between the first end and the second end of the multilayer substrate in a stacking direction to provide a plurality of substrate faces, which include:

a top substrate face that is placed in the first end of the multilayer substrate and includes a strip line and a first short-circuiting metal pattern, which are spaced from each other;

a first intermediate substrate face that is positioned on a waveguide side of the top substrate face in the stacking direction and includes a second short-circuiting metal pattern, which has an opening;

a second intermediate substrate face that is positioned on a waveguide side of the first intermediate substrate face in the stacking direction and includes a third short-circuiting metal pattern, which has an opening; and a matching element substrate face that is positioned on a waveguide side of the second intermediate substrate face and includes a matching element, which is electromagnetically coupled with the strip line, and a fourth short-circuiting metal pattern, which has an opening, wherein:

a waveguide passage extends through the opening of the second short-circuiting metal pattern and the opening of the third short-circuiting metal pattern in the stacking direction between the strip line and the matching element in the multilayer substrate;

the first short-circuiting metal pattern, the second short-circuiting metal pattern, the third short-circuiting metal pattern, the fourth short-circuiting metal pattern, and the waveguide are grounded together;

a portion of an inner edge of the opening of the third short-circuiting metal pattern, which is overlapped with the strip line in the stacking direction, is further recessed away from a center axis of the wave guide in comparison to a portion of an inner edge of the opening of the second short-circuiting metal pattern, which is overlapped with the strip line in the stacking direction; and a cross sectional area of the opening of the third short-circuiting metal pattern is larger than a cross sectional area of the opening of the fourth short-circuiting metal pattern.

7. The waveguide/strip line converter according to claim 6, wherein a cross sectional area of the opening of the third short-circuiting metal pattern is larger than a cross sectional area of the opening of the second short-circuiting metal pattern.

8. The waveguide/strip line converter according to claim 6, wherein the matching element substrate face is spaced from the second end of the multilayer substrate on a top substrate face side of the second end of the multilayer substrate in the stacking direction.

9. The waveguide/strip line converter according to claim 6, wherein the matching element substrate face is positioned in the second end of the multilayer substrate.

* * * * *